US009046810B2

(12) United States Patent
Morimoto

(10) Patent No.: US 9,046,810 B2
(45) Date of Patent: Jun. 2, 2015

(54) IMAGE FORMING APPARATUS AND CONTROL METHOD OF IMAGE FORMING APPARATUS

(71) Applicant: Hiroshi Morimoto, Akiruno (JP)

(72) Inventor: Hiroshi Morimoto, Akiruno (JP)

(73) Assignee: KONICA MINOLTA, INC. (JP)

( * ) Notice: Subject to any disclaimer, the term of this patent is extended or adjusted under 35 U.S.C. 154(b) by 123 days.

(21) Appl. No.: 13/690,804

(22) Filed: Nov. 30, 2012

(65) Prior Publication Data

US 2013/0142529 A1 Jun. 6, 2013

(30) Foreign Application Priority Data

Dec. 1, 2011 (JP) ..... 2011-263903

(51) Int. Cl.

| | |
|---|---|
| ***G03G 15/08*** | (2006.01) |
| ***G03G 13/08*** | (2006.01) |
| ***G03G 15/00*** | (2006.01) |
| ***G03G 21/00*** | (2006.01) |

(52) U.S. Cl.

CPC ..... *G03G 13/08* (2013.01); *G03G 15/5008* (2013.01); *G03G 21/0094* (2013.01)

(58) Field of Classification Search

CPC ..... G03G 13/06; G03G 13/08
USPC ..... 399/53
See application file for complete search history.

(56) References Cited

U.S. PATENT DOCUMENTS

2010/0080602 A1* 4/2010 Taguma ..... 399/71

FOREIGN PATENT DOCUMENTS

| | | | | |
|---|---|---|---|---|
| JP | 2005-77717 A | | 3/2005 | |
| JP | 2005077717 A | * | 3/2005 | ..... G03G 21/00 |
| JP | 2005-250346 A | | 9/2005 | |
| JP | 2006-78957 A | | 3/2006 | |
| JP | 2006078957 A | * | 3/2006 | |
| JP | 2009-294248 A | | 12/2009 | |
| JP | 2010-79019 A | | 4/2010 | |
| JP | 2011-154055 A | | 8/2011 | |
| JP | 2011154055 A | * | 8/2011 | |

OTHER PUBLICATIONS

Notification of Reasons for Refusal for Japanese Patent Application No. 2011-263903, mailed Oct. 15, 2013, with English translation.

* cited by examiner

*Primary Examiner* — David Gray
*Assistant Examiner* — Michael Harrison
(74) *Attorney, Agent, or Firm* — Cantor Colburn LLP

(57) ABSTRACT

An image forming apparatus has an image carrying member on a surface of which a latent image is formed, a developing roller to develop the latent image on the surface of the image carrying member by providing a developer to the latent image, a smoother, an applying roller to apply the smoother to the surface of the image carrying member, and a controller to determine whether the image forming apparatus is in a waiting mode wherein the image carrying member is moved and is ready for a subsequent image forming operation. The controller controls a rotation and a stop of the rotation of the developing roller when the controller determines that the image forming apparatus is in the waiting mode.

15 Claims, 7 Drawing Sheets

| | | Image forming mode | Standby mode | Image forming mode |
|---|---|---|---|---|
| Image forming | ON | | | |
| | OFF | | | |
| Post processing device | ON | | | |
| | OFF | | | |
| Developing roller | ON | | | |
| | OFF | | | |
| Photoreceptor drum | ON | | | |
| | OFF | | | |
| Applying roller | ON | | | |
| | OFF | | | |
| Intermediate transfer belt | ON | | | |
| | OFF | | | |

IMAGE FORMING APPARATUS AND CONTROL METHOD OF IMAGE FORMING APPARATUS

CROSS-REFERENCE TO RELATED APPLICATION

This application is based on Japanese Patent Application No. 2011-263903 filed on Dec. 1, 2011, the contents of which are incorporated herein by reference.

BACKGROUND

1. Technical Field

The present invention relates to an image forming apparatus and a control method of image forming apparatus.

2. Description of Related Art

It is important for an image forming apparatus to maintain the surface condition of an image carrying member such as a photoreceptor drum in an optimum condition in order to maintain the quality of a toner image to be transferred to a recording sheet uniform.

It is a customary practice to apply a smoother (lubricant) on the surface of the image carrying member in order to improve the transferability of the image carrying member and to stabilize the surface condition of the image carrying member. The application of the smoother is implemented by a roller that is contacting a bar of the smoother. The roller scrapes up the smoother and the scraped up smoother is applied on the image carrying member.

Such a technology of smoother application to the surface of the image carrying member using a roller is disclosed, for example, by Japanese Publication of Patent Application No. 2009-294248. The particular technology pertains to detecting the load of the rotation of the image carrying member during the image forming process and changing the roller's rpm relative to the detected load, in order to control the amount of the smoother to be applied to the surface of the image carrying member. In the particular technology, the load of the rotation of the image carrying member is detected by the electric current that runs through the motor that drives the image carrying member, and the roller's rpm is changed depending on the detected current by having the roller's rpm which is determined in correspondence with the current in advance.

However, such a prior art is a technology concerning a control during formation of images and is not a technology concerning smoother application to the surface of the image carrying member while the system is in an image forming standby status.

The image forming standby status means a status where the image carrying member is rotating for forming the next image, while the developing member that supplies the developing agent to the image carrying member is not operating. In other words, although the smoother continues to be applied on the image carrying member's surface, the developing agent is not supplied. Therefore, in the image forming apparatus of the prior art, the condition of smoother application on the image carrying member's surface varies from the condition during the image formation so that the amount of smoother applied on the image carrying member's surface can become inappropriate during the image forming standby status.

SUMMARY

The main objective of the present invention is to provide an improved image forming apparatus and a method of control for the image forming apparatus. Another objective of the present invention is to provide an image forming apparatus and a method of control for the image forming apparatus capable of maintaining an appropriate amount of smoother on the image carrying member's surface during an image forming standby status. To achieve at least one of the abovementioned objects, an image forming apparatus reflecting one aspect of the present invention comprises: a rotatable image carrying member on a surface of which a latent image is formed, a developing roller to develop the latent image on the surface of the image carrying member by providing a developer to the latent image, a smoother, an applying roller in contact with the surface of the image carrying member to apply the smoother to the surface of the image carrying member, and a controller to determine whether the image forming apparatus is in a waiting mode wherein the image carrying member is rotated and is ready for a subsequent image forming operation, wherein the controller controls a rotation and a stop of the rotation of the developing roller when the controller determines that the image forming apparatus is in the waiting mode.

The controller preferably controls a rotation and a stop of the rotation of the applying roller when the image forming apparatus is in the waiting mode.

The image forming apparatus preferably comprises a load measurement section to measure load of the rotation of the image carrying member, and wherein the controller rotates the developing roller when the load of the rotation of the image carrying member measured by the load measurement section is within a predetermined range and stops the rotation of the developing roller when the load of the rotation of the image carrying member measured by the load measurement section is out of the predetermined range.

The image forming apparatus preferably comprises a motor to rotate the image carrying member, and a current measurement section to measure an electric current on the motor; and wherein the load measurement section measures load of the rotation of the image carrying member based on the electric current measured by the current measurement section.

The image forming apparatus preferably comprises a time measurement section to measure a length of time that has elapsed since the determination of that the image forming apparatus is in the waiting mode, and wherein the controller rotates the developing roller when the length of the time measured by the time measurement section is within a predetermined range and stops the rotation of the developing roller when the length of the time measured by the time measurement section is out of the predetermined range.

The controller preferably controls the developing roller to form a patch image on the surface of the image carrying member at a predetermined timing during the rotation of the developing roller in the waiting mode.

The image forming apparatus preferably comprises a load measurement section to measure load of the rotation of the image carrying member, and wherein the controller rotates the applying roller when the load of the rotation of the image carrying member measured by the load measurement section is within a predetermined range and stops the rotation of the applying roller when the load of the rotation of the image carrying member measured by the load measurement section is out of the predetermined range.

The image forming apparatus preferably comprises a motor to rotate the image carrying member, and a current measurement section to measure an electric current on the motor; and wherein the load measurement section measures load of the rotation of the image carrying member based on the electric current detected by the current measurement section.

The image forming apparatus preferably comprises a time measurement section to measure a length of time that has elapsed since the determination of that the image forming apparatus is in waiting mode, and wherein the controller rotates the applying roller when the length of the time measured by the time measurement section is within a predetermined range and stops the rotation of the applying roller when the length of the time measured by the time measurement section is out of the predetermined range.

To achieve at least one of the abovementioned objects, a method performed in an image forming apparatus reflecting one aspect of the present invention comprises: the steps of: forming a latent image on a surface of a rotatable image carrying member, developing the latent image formed on the surface of the image carrying member by providing a developer from a developing roller to the latent image, applying a smoother to the surface of the image carrying member by an applying roller, determining whether the image forming apparatus is in a waiting mode wherein the image carrying member is rotated and is ready for a subsequent image forming operation, and controlling an amount of the smoother applied on the surface of the image carrying member when the controller determines that the image forming apparatus is in the waiting mode.

The method preferably comprises a step of controlling a rotation of and a stop of the rotation of the developing roller for controlling the amount of the smoother applied on the surface of the image carrying member when the image forming apparatus is in the waiting mode.

The method preferably comprises a step of controlling a rotation of and a stop of the rotation of the applying roller for controlling the amount of the smoother applied on the surface of the image carrying member when the image forming apparatus is in the waiting mode.

The method preferably comprises the steps of: measuring load of the rotation of the image carrying member, and rotating the developing roller when the measured load of the rotation of the image carrying member is within a predetermined range and stopping the rotation of the developing roller when the measured load of the rotation of the image carrying member is out of the predetermined range.

The method preferably comprises a step of measuring an electric current on a motor which rotates the image carrying member, and wherein the load of the rotation of the image carrying member is measured based on the measured electric current.

The method preferably comprises the steps of: measuring a length of time that has elapsed since the determination of that the image forming apparatus is in the waiting mode, and rotating the developing roller when the measured length of the time is within a predetermined range and stopping the rotation of the developing roller when the measured length of the time is out of the predetermined range.

The method preferably comprises a step of controlling the developing roller to form a patch image on the surface of the image carrying member at a predetermined timing during the rotation of the developing roller in the waiting mode.

The method preferably comprises the steps of: measuring load of the rotation of the image carrying member, and rotating the applying roller when the measured load of the rotation of the image carrying member is within a predetermined range and stopping the rotation of the applying roller when the measured load of the rotation of the image carrying member is out of the predetermined range.

The method preferably comprises a step of measuring an electric current on a motor which rotates the image carrying member, and wherein the load of the rotation of the image carrying member is measured based on the measured electric current.

The method preferably comprises the steps of: measuring a length of time that has elapsed since the determination of that the image forming apparatus is in the waiting mode, and rotating the applying roller when the measured length of the time is within a predetermined range and stopping the applying roller when the measured length the time is out of the predetermined range.

DETAILED DESCRIPTION OF THE PREFERRED EMBODIMENTS

Herein below, typical embodiments of the present invention will be explained with reference to the drawings. It should be note that the present invention is not limited to the embodiments described below. Definitions of terms described below are given by way of explanation of the terms only, and thus the definitions of the terms of the inventions are not limited thereto.

Figure 1:
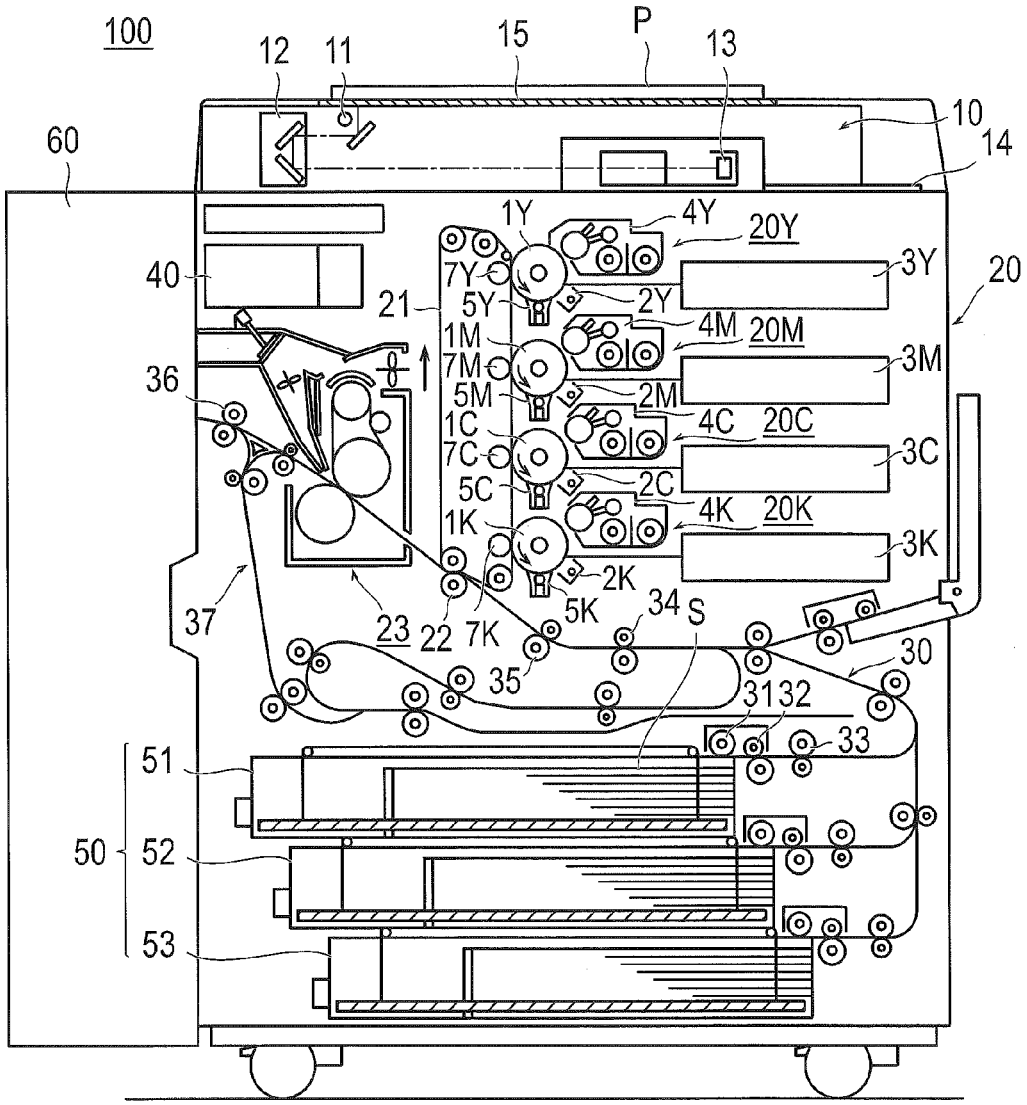
FIG. 1 is a rough cross-sectional view showing the overall configuration of an image forming apparatus according to an embodiment of the present invention.

FIG. 1 is a cross-sectional view showing the overall configuration of an image forming apparatus according to the first embodiment of the present invention. Such an image forming apparatus is applicable to copying machines, printers, and MFPs (Multifunction Peripherals). In describing the present embodiment, a copying machine is used as an example of the image forming apparatus.

As shown in FIG. 1, the image forming apparatus 100 of the present embodiment has an image scanning part 10, an image forming part 20, a paper transport part 30, a control part 40, a paper supply part 50, and a post-processing part 60. The following description will focus on the major composition of the image forming apparatus 100 of the present embodiment, and omit the description of the compositions identical to those of the conventional image forming apparatuses.

The image scanning part 10 scans the image of the document and stores scanned image data. The image scanning part 10 is equipped with a light source 11, an optical system 12, an imaging element 13, and an image processing system 14.

The light emitted from the light source 11 is irradiated on a document P laid on a scanning plane 15. The reflected light from the document P is focused via an optical system 12 on an imaging element 13 that has been moved to a scanning position. The imaging element 13 generates electric signals corresponding to the intensity of the light reflected from the document P. The generated electric signals are treated by a compensation process, a filtration process, an image compression process, and the like after having been converted from analog signals to digital signals in the image processing system 14, and are stored in the storage section (not shown) of the image processing system 14 as image data.

The image forming part 20 forms an image by the electrophotographic process, and the formed image is fixed on a recording sheet S, which is used as the recording medium. The image forming part 20 of the present embodiment comprises an image forming part 20Y that forms an yellow (Y) color image, an image forming part 20M that forms a magenta (M) color image, an image forming part 20C that forms a cyan (C) color image, and an image forming part 20K that forms a black (K) color image, each of which is identified here with a symbol representing each color, i.e., Y, M, C, and K respectively following the common symbol 20.

The image forming part 20Y consists of an image carrying member, i.e., a photoreceptor drum 1Y, as well as its peripheral parts including a charging part 2Y provided on the periphery thereof, an optical writing part 3Y, a developing device 4Y, and a drum cleaner 5Y. The photoreceptor drum 1Y rotates at a specified speed driven by a drum motor.

Similarly, the image forming part 20M consists of a charging part 2M provided on the periphery of the photoreceptor drum 1M, an optical writing part 3M, a developing device 4M, and a drum cleaner 5M. Also, the image forming part 20C consists of a charging part 2C provided on the periphery of the photoreceptor drum 1C, an optical writing part 3C, a developing device 4C, and a drum cleaner 5C. Also, the image forming part 20K consists of a charging part 2K provided on the periphery of the photoreceptor drum 1K, an optical writing part 3K, a developing device 4K, and a drum cleaner 5K.

The photoreceptor drums 1Y, 1M, 1C, and 1K, the charging parts 2Y, 2M, 2C, and 2K, the optical writing parts 3Y, 3M, 3C, and 3K, the developing devices 4Y, 4M, 4C, and 4K, as well as the drum cleaners 5Y, 5M, 5C, and 5K, all of which belonging to each of the image forming parts 20Y, 20M, 20C, and 20K respectively are the contents common to all of those image forming parts. Those symbols may sometimes be written in the following without symbols Y, M, C, and K.

The image forming part 20 forms a latent image on the photoreceptor drum 1 by irradiating light on the photoreceptor drum 1 by the optical writing part 3 based on the image data stored in the storage section of the image processing system 14. The latent image is developed by the developing device 4 to form a toner image as a visible image on the photoreceptor drum 1.

Yellow (Y), magenta (M), cyan (C), and black (K) images are formed on the photoreceptor drums 1Y, 1M, 1C, and 1K of the image forming parts 20Y, 20M, 20C, and 20K respectively.

An intermediate transfer belt 21 is supported by a plurality of rollers and is driven to turn around. Toner images of individual colors formed by the image forming parts 20Y, 20M, 20C, and 20K are transferred one by one on the running intermediate transfer belt 21 by the primary transfer part 7Y, 7M, 7C, and 7K respectively. This ends up forming on the intermediate transfer belt 21 a color toner image formed by overlaying individual color layers of Y (yellow), M (magenta), C (cyan), and K (black).

The paper transport part 30 transports the recording sheet S. The recording sheet S is stored in a paper supply tray 51, 52 or 53 of the paper supply part 50. The paper transport part 30 is equipped with a send-out roller 31, a handling roller 32, a transport roller 33, a loop roller (intermediate roller) 34, and a resist roller 35.

The recording sheet S is sent out from the paper supply tray 51, 52, or 53 by means of the send-out roller 31 and separated into individual sheets by the handling roller 32. The recording sheet S separated into individual sheets is transferred to a secondary transfer part 22 via a loop roller 34 and a resist roller 35 along a transfer route by means of the transport roller 33.

The color toner image on the intermediate transfer belt 21 is then transferred onto the recording sheet S in the secondary transfer part 22. The recording sheet S on which the color toner image is transferred is transported to the fixing part 23, applied with heat and pressure in the fixing part 23 in order to have the toner image on the recording sheet S fixed, and discharged via the paper discharge roller 36 to the outside of the image forming apparatus 100.

The image forming apparatus 100 is equipped with the paper turning part 37 so that it can guide the recording sheet S on which the fixation is completed to the paper turning part 37 to have it flipped over before discharging it. Thus it is capable of forming images on both sides of the recording sheet S.

The control part 40 controls the image scanning part 10, the image forming part 20, the paper transport part 30, and the post-processing device 60. The control part 40 is equipped with a CPU (Central Processing Unit), a RAM (Random Access Memory), and a ROM (Read Only Memory). The CPU controls the image scanning part 10, the image forming part 20, the paper transport part 30, and the post-processing device 60 based on the software program stored on the ROM, and stores the arithmetic results and others on the RAM. The control part 40, particularly in the present embodiment, controls the developing device 4 and the drum cleaner 5 in the standby status as described later.

The post-processing device 60 provides various post-processes to the recording sheet S which has been discharged from the image forming part 20. The post-processes include, among others, sorting, stapling, punching and bookbinding processes. Of these, in the bookbinding process, after the recording sheets S of all the pages to be bound are received from the image forming part 20, a cover sheet is supplied as needed, so that the recording sheets S and the cover sheet are glued to be discharged from the post-processing device 60. In a bookbinding process such as this, the post-processing device 60 cannot receive the recording sheet S for the next bookbinding process until a product finished with bookbinding is discharged from the post processing device 60. As a consequence, in a bookbinding operation, the image forming part 20 goes into the standby mode until the bookbinding operation (post-processing operation) at the post-processing device 60 is completed. If the post-processing device 60 cannot receive recording sheets S because the post-processing device 60 is in operation, not necessarily for the sake of the bookbinding operation, the image forming part 20 goes into the standby mode as well.

Figures 2, 3:
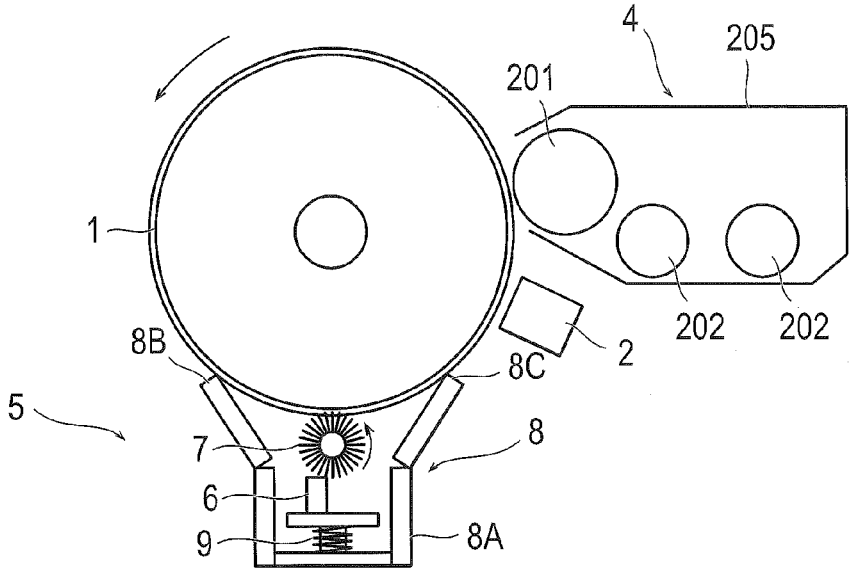
FIG. 2 is a rough cross-sectional view for describing the photoreceptor drum, the developing device, the charging part, and the drum cleaner shown in FIG. 1.
FIG. 3 is a diagram showing the conventional sequences of the image forming mode and the standby mode.

The photoreceptor drum, developing device, charging part and drum cleaner in the image forming part will be described in detail below by referring to FIG. 2. FIG. 2 is a cross-sectional view for describing the photoreceptor drum, the developing device, the charging part, and the drum cleaner shown in FIG. 1.

The charging part 2 charges the entire surface of the photoreceptor drum 1.

The developing device 4 is equipped with a developing roller 201 and an agitator 202, which agitates a developing agent consisting of two components (toner and carrier), provided inside a case 205 holding the developing agent. The development roller 201 is provided in such a way as to face the outside periphery of the photoreceptor drum 1 and to be capable of rotating freely at a proper distance (developing gap) apart from the surface of the photoreceptor drum 1. The amount of this developing gap varies depending on the equipment model and the developing agent, for example, 0.2-0.5 mm. The start and stop of rotation of the developing roller 201 is controlled by the control part 40.

The drum cleaner 5 keeps the surface of the photoreceptor drum 1 in a preferable condition by scraping off the toner and the additives remaining on the surface of the photoreceptor drum 1 after the toner image is transferred to the intermediate transfer belt 21.

The drum cleaner 5 has a smoother 6, an applying roller 7, and a case part 8. The case part 8 has a casing member 8A, a cleaning blade 8B, and a smoother uniformalizing blade 8C.

The smoother 6 contains, for example, hydrophobic solid materials such as zinc stearate (Zn—St), and is provided on a supporting member placed in a casing member 8A to exist in a plate-like shape extending along the axis of rotation of the photoreceptor drum 1. The smoother 6 is scraped up by the applying roller 7. As the applying roller 7 rotates abutting the photoreceptor drum 1, the smoother is applied to the surface of the photoreceptor drum 1. The friction between the surface of the photoreceptor drum 1 and the cleaning blade 8B is adjusted by this way. The smoother 6 is pressed onto the applying roller 7 by means of a spring (elastic member) 9.

The applying roller 7 is a brush made of, for example, a plastic material, including an acrylic material. In order to scrape the smoother which is substantially a solid material, the hair of the brush has a certain degree of tenacity (hardness), while it has softness not to damage the surface of the photoreceptor drum 1 at the same time.

The case part 8 is a case containing the smoother 6 and the applying roller 7, and also supports the cleaning blade 8B and the smoother uniformalizing blade 8C.

The cleaning blade 8B scrapes off the residual substances on the surface of the photoreceptor drum 1. More specifically, the cleaning blade 8B scrapes off the residual substances on the surface of the photoreceptor drum 1 by causing one end of the cleaning blade 8B to be in sliding contact with the photoreceptor drum 1 in the opposite direction (counter direction) relative to the rotating direction of the photoreceptor drum 1.

The smoother uniformalzing blade 8C uniformalizes the smoother applied to the surface of the photoreceptor drum 1 by the applying roller 7. More specifically, the smoother uniformalizing blade 8C is located on the downstream side of the cleaning blade 8B relative to the rotating direction of the photoreceptor drum 1, having one of which sliding over the photoreceptor drum 1, uniformalizes the smoother applied on the surface of the photoreceptor drum 1 and forms a thin smoother layer.

FIG. 3 is a diagram showing the conventional sequences of the image forming mode and the standby mode.

When the system is in the image forming mode, i.e., in the image forming period, the image forming is ON, the post-processing device is OFF, the developing roller is ON, the photoreceptor drum is ON, the applying roller is ON, and the intermediate transfer belt is ON. Here, "ON" signifies that the particular item is in operation, in particular, rotating, if the particular item is referring to a rotating member. "OFF" signifies that the item is not in operation, in particular, not rotating, if the particular item is referring to a rotating member (the same hereunder).

The developing roller 201 rotates driven by the developing roller motor (not shown) in the direction opposite to the direction of the rotation of the photoreceptor drum 1 (in other words, the surface of the photoreceptor drum 1 moves in the same direction as the motion of the surface of the developing roller 201). During the image forming process, the developing roller 201 rotates to supply the developing agent on the surface of the photoreceptor drum 1. The developing agent supplied sticks to the surface of the photoreceptor drum 1 and allows the electrostatic latent image on the surface of the photoreceptor drum 1 to develop. The developing agent left unused is scraped off together with a portion of the smoother by the cleaning blade 8B.

On the other hand, in the standby mode, the image forming is OFF, the post-processing device is ON, the developing roller is OFF, the photoreceptor drum is ON, the applying roller is ON, and the intermediate transfer belt is ON.

Consequently, the developing roller 201 stops although the photoreceptor drum 1 continues to rotate. Moreover, during the standby mode, not only the photoreceptor drum 1 but also the intermediate transfer belt 21 and the applying roller 7 for applying the smoother continue to rotate (i.e., in motion).

The amount of the smoother applied is adjusted to be adequate considering the fact that both the photoreceptor drum 1 and the developing roller 201 are rotating and together with the smoother the developing agent adhered to the surface of the photoreceptor drum 1 gets scraped off by the cleaning blade 8B. As the developing roller 201 stops in the standby mode, only the smoother will be supplied to the surface of the photoreceptor drum 1. This caused a problem of making the amount of the smoother inappropriate, by making either the smoother layer too thin due to the smoother being scraped off by the cleaning blade 8B, or too thick as the smoother is not consumed by the developing roller 201.

If the amount of the smoother deviated from the appropriate level, following problems may occur. If the smoother layer gets too thick, inappropriate cleaning of the intermediate transfer belt 21 and/or poor images due to inappropriate forming of latent images on the photoreceptor drum 1 may result. On the contrary, if the smoother layer gets too thin, it may result in shortening of the lives of the photoreceptor drum 1 and the cleaning blade 8B due to increased friction between the photoreceptor drum 1 and cleaning blade 8B and increased torque of the photoreceptor, as well as in image failures due to inadequate cleaning.

Therefore, in the present embodiment, it is attempted to keep the developing roller and the applying roller operating during the standby mode as well in order to make the amount of the smoother on the surface of the photoreceptor drum appropriate during the standby mode.

Three different control procedures to be applied in controlling the developing roller and the applying roller during the standby mode will be described to illustrate the features of the present embodiment bellow.

The first control procedure is as follows. In the first control procedure, the load of the rotation of the photoreceptor drum 1 during the standby mode is detected in order to control the operations of the developing roller and the applying roller in accordance with the load. The rotation load is detected here by measuring the electric current that runs through a drum motor 101 that drives the photoreceptor drum 1.

Figure 4:
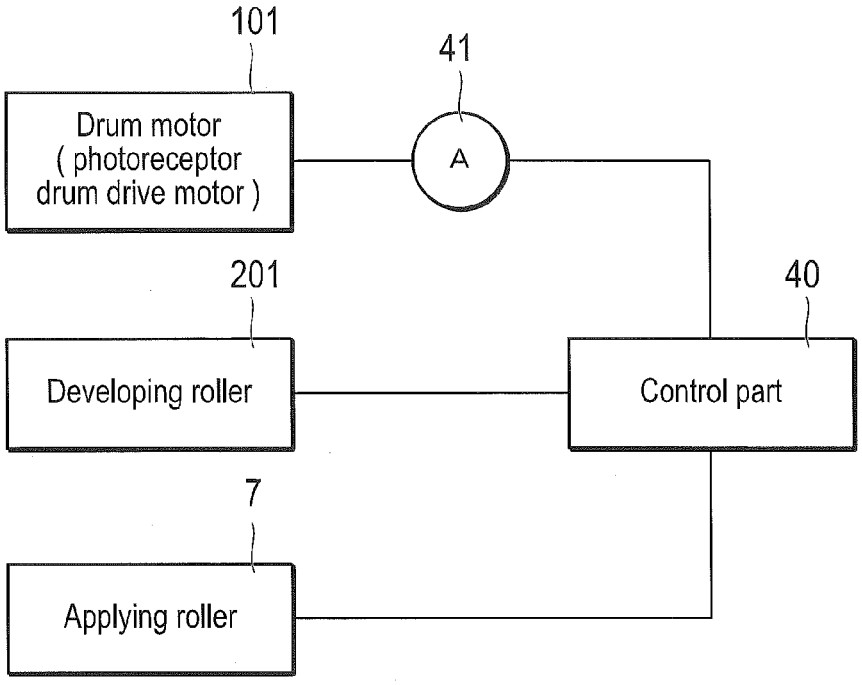
FIG. 4 is a block diagram for describing a control system for controlling a developing roller and a applying roller for executing a first control procedure.

FIG. 4 is a block diagram for describing the control system for controlling a developing roller and an applying roller.

The control system has a drum motor 101 to drive the photoreceptor drum 1. And the control system has an ammeter 41 to measure the current that runs through the drum motor 101. The measurement value from the ammeter 41 is supplied to the control part 40. The control part 40 is connected to the developing roller 201 and the applying roller 7 respectively, while the control part 40 issues a signal to control them to run and stop.

Figure 5:
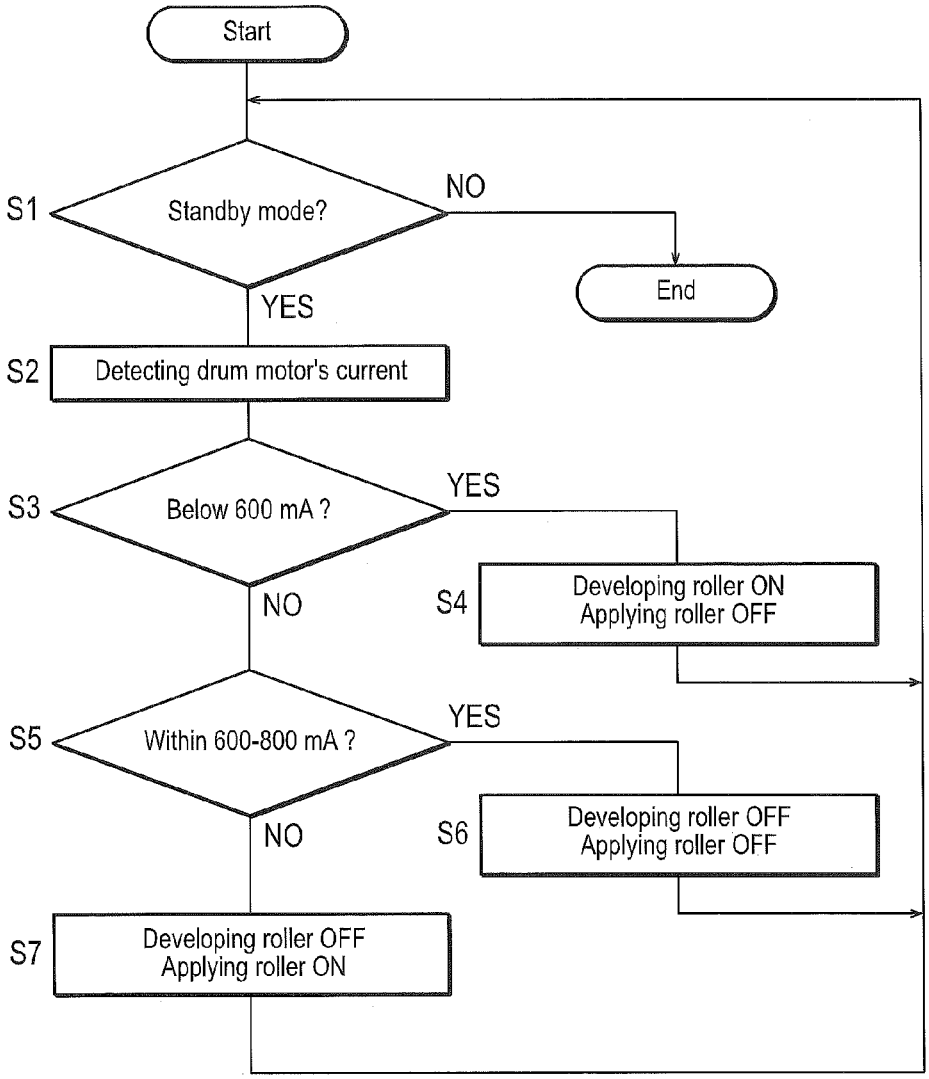
FIG. 5 is a flowchart showing the first control procedure by the control part.

FIG. 5 is a flowchart showing the first control procedure by the control part 40. In this first control procedure, the rotational load of the photoreceptor drum 1 is determined by measuring the current of the drum motor 101 that drives it in order to control the developing roller 201 and the applying roller 7 to run and stop. In the following description, ON signifies to run (rotate) and OFF signifies to stop.

First, the control part 40 determines whether it is in the standby mode or not (S1). The standby mode signifies a condition wherein the photoreceptor drum 1 is rotating in preparation of the next image forming cycle but the developing roller 201 is not running. In the present embodiment, the standby mode is detected by the control part 40 receiving the ON signal of the post-processing device. Whether the standby mode is in effect at the moment or not can also be ascertained, while a printer server (not shown) and the like is connected to the image forming apparatus 100 and rasterization is in process using the printer server, by detecting the receipt of a signal from the printer server indicating that rasterization process is in process for forming the next image after the completion of the previous image formation cycle.

If it is not in the standby mode (S1: NO) at this time, the process is terminated.

On the other hand, if the standby mode is detected (S1: YES), the system starts the control for the standby mode. This control is different from the sequence shown in FIG. 3. In the control process unique to the standby mode, the control part 40 receives the value of the current that flows from the ammeter 41 to drum motor 101 (S2).

The control part 40 controls the developing roller to be ON and the applying roller to be OFF when the current of the drum motor 101 is lower than 600 mA (S3: YES) (S4). In other words, the developing roller 201 runs but the applying roller 7 does not run in this case. In this condition, the current of the drum motor 101 that drives the photoreceptor drum 1 is as low as 600 mA or less, indicating that the torque to drive the photoreceptor drum 1 is low. This means that the condition is such that the load on the photoreceptor drum is low, i.e., the surface of the photoreceptor drum 1 is well lubricated causing little friction. Therefore, the applying roller 7 is stopped to stop the supply of the smoother to the photoreceptor drum 1, and at the same time the developing roller 201 is started to run. At this time the developing roller 201 does not supply the smoother. As a result, the excess smoother is picked up by the developing roller 201 because the developing roller 201 and the photoreceptor drum 1 are separated by a short distance between them resultantly reducing the smoother on the surface of the photoreceptor drum 1 to make it an appropriate amount.

On the other hand, if the current value of the drum motor 101 is more than 600 mA (S3: NO), the control part 40 determines whether the current value of the drum motor 101 is higher than 600 mA but lower than 800 mA or not (S5). The control part 40 controls the developing roller to be OFF and the applying roller to be OFF when the current value of the drum motor 101 is higher than 600 mA but lower than 800 mA (S5: YES) (S6). In other words, both the developing roller 201 and the applying roller 7 stop running in this case. In this condition, the current value of the drum motor 101 that drives the photoreceptor drum 1 indicates that the photoreceptor drum 1 is being driven at an appropriate torque. This means that the amount of the smoother on the surface of the photoreceptor drum 1 is appropriate. Therefore, both the developing roller 201 and the applying roller 7 are stopped to maintain this condition.

If the current value is not within the range of 600-800 mA (S5: NO) in the step S5, it means that the current value is over 800 mA. In such a case, the control part 40 makes the developing roller to be OFF and the applying roller to be ON (S7). In other words, stop the developing roller 201 and run the applying roller 7 in this case. Under this condition, the friction becomes high and the torque increases as well. This means that the condition is such that the load on the photoreceptor drum is too high, i.e., the surface of the photoreceptor drum is becoming short of the smoother. Therefore, it is meant to keep a proper amount of the smoother by increasing the supply of the smoother on the surface of the photoreceptor drum 1 by rotating the applying roller 7 while keeping the developing roller stopped.

After the steps S4, S6 and S7, the process returns to the step S1 and continues the process of the step S2 and thereafter, if the standby mode is confirmed according to the judgment (S1).

Table 1 shows the relation between the current value of the drum motor 101 and the ON/OFF statuses of the developing roller 201 and the applying roller 7 in the first control procedure described above.

TABLE 1

| | Current of drum motor | | |
|---|---|---|---|
| | Below 600 mA | 600-800 mA | Over 800 mA |
| Developing roller | ON | OFF | OFF |
| Applying roller | OFF | OFF | ON |

As can be seen in the above, the first control procedure is to control the amount of the smoother on the surface of the photoreceptor drum 1 according to the load applied on the photoreceptor drum 1. Thus the developing roller 201 is run when the current value of the drum motor 101 is in a range that is lower than 600 mA. Also, the applying roller 7 is run when the current value of the drum motor is in a range that is higher than 800 mA.

Next, the second control procedure is as follows. The second control procedure is to control the developing roller and the applying roller with time during the standby mode. Therefore, the ammeter does not necessarily have to be provided in the image forming apparatus 100 in the second procedure.

Figure 6:
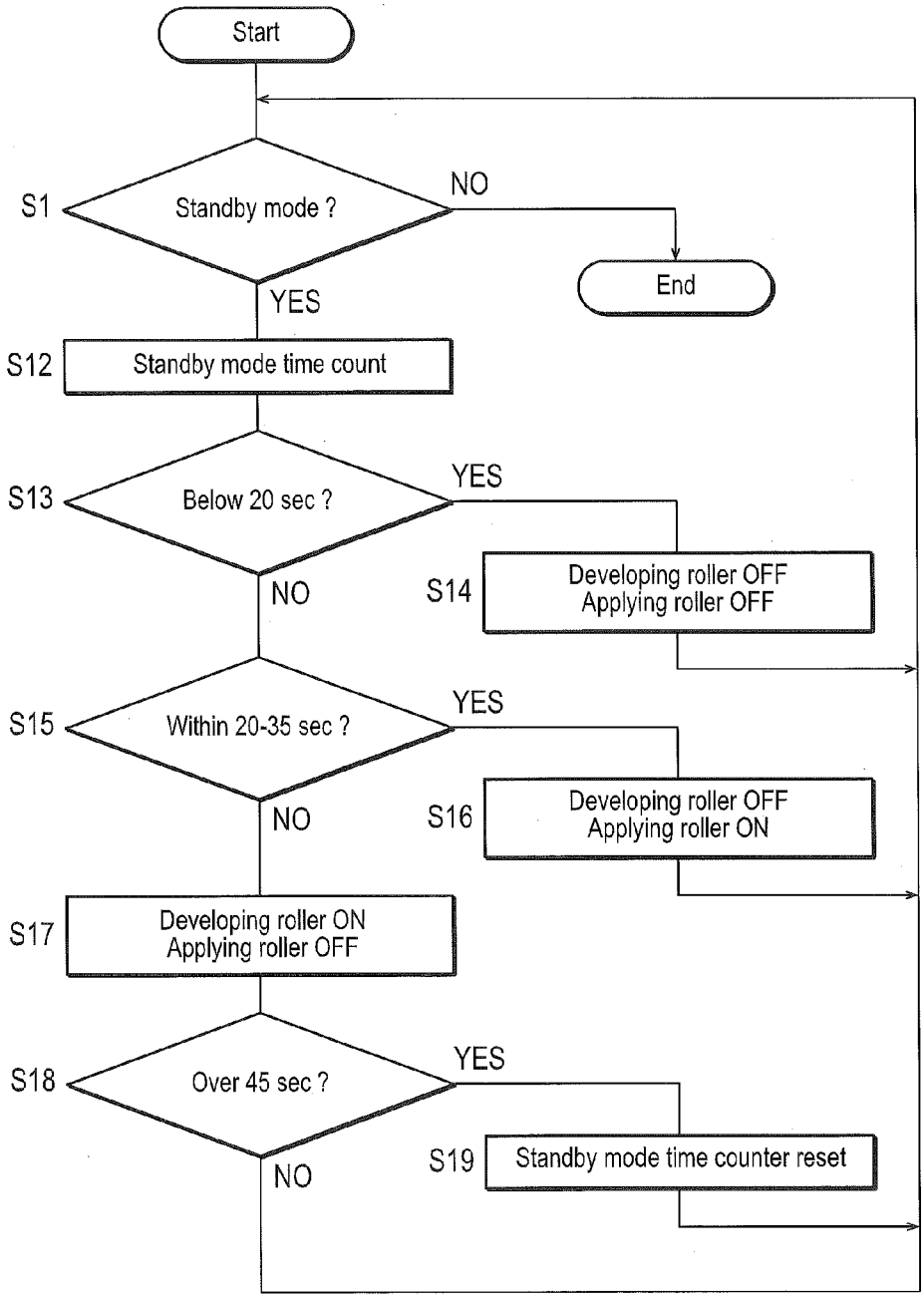
FIG. 6 is a flowchart showing a second control procedure by the control part.

FIG. 6 is a flowchart showing the second control procedure by the control part 40.

First, similar to the first control procedure, a determination is made as to whether or not it is the standby mode, and it proceeds on to the control unique to the standby mode if it is determined to be the standby mode (S1: YES).

Next, in the second control procedure, the control part 40 starts to count the time elapsed since the standby mode has started (S12).

While the elapsed time is less than 20 seconds (S13: YES), the control part 40 keeps the developing roller OFF and the applying roller OFF. In other words, both the developing roller 201 and the applying roller 7 are kept stopped (S14). At this stage, not much time has passed since the standby mode has started, so the amount of the smoother on the surface of the photoreceptor drum 1 is appropriate by means of the control at the time of image formation. Therefore, it is planned to keep the amount of the smoother as is by stopping both the developing roller 201 and the applying roller 7. This condition is held unchanged until the elapsed time exceeds 20 seconds.

After the elapsed time reached 20 seconds (S13: NO), the control part 40 makes a determination as to whether the elapsed time is within the range of 20-35 seconds or not (S15). If the elapsed time is within the range of 20-35 seconds (S15: YES), the developing roller is turned OFF and the applying roller is turned ON. In other words, stop the developing roller 201 and run the applying roller 7 in this case (S16). This is the stage wherein a certain amount of time has passed since the start of the standby mode and the amount of the smoother on the surface of the photoreceptor drum 1 is decreasing. Therefore, it is intended to increase the smoother by rotating the applying roller 7. This condition is held unchanged until the elapsed time exceeds 35 seconds.

In S15, if the elapsed time has reached 35 seconds (S15: NO), i.e., the elapsed time is equal or higher than 35 seconds, the control part 40 turns the developing roller ON and the applying roller OFF. In other words, the developing roller 201 runs but the applying roller 7 does not run in this case (S17). At this stage, the amount of the smoother on the surface of the photoreceptor drum 1 is increasing, as the applying roller 7 is started to run while the elapsed time is between 20 seconds and 35 seconds in order to increase the amount of the smoother. If applying roller 7 is kept running in this condition, the amount of the smoother on the surface of the photoreceptor drum 1 may become too much. Therefore, it is meant to keep a proper amount of the smoother by decreasing the supply of the smoother on the surface of the photoreceptor drum 1 by stopping the applying roller 7 and keeping the developing roller 201 running.

Later, when the elapsed time reaches 45 seconds (S18: YES), the time counter for the standby mode is reset (set to 0 (zero)) (S19) and the process returns to the step S1. In other words, each time when the elapsed time reaches 45 seconds, the cycle of S1 through S19 steps is repeated. Thus the control cycle of the smoother is repeated even if the standby mode continues for a long time. Moreover, if the elapsed time is less than 45 seconds in the step S18, as well as after the steps S14 and S16, the process returns to the step S1 to make a judgment of whether it is the standby mode or not (S1), and continues the processes of the step S12 and thereafter if the standby mode is confirmed. Although the elapsed time is reset to 0 when the control enters the step S12 for the first time, the elapsed time is continued without resetting when the elapsed time at the step S18 is less than 45 seconds as well as when the control enters the step S12 after returning to the step S1 following the steps S14 and S16.

Table 2 shows the relation between the elapsed time in the standby mode and the ON/OFF statuses of the developing roller 201 and the applying roller 7 in the second control procedure described above.

TABLE 2

| | Elapsed time of standby mode | | |
|---|---|---|---|
| | Below 20 sec | 20-35 sec | Over 35 sec (Below 45 sec) |
| Developing roller | OFF | OFF | ON |
| Applying roller | OFF | ON | OFF |

As can be seen in the above, the second control procedure is to control the amount of the smoother on the surface of the photoreceptor drum 1 according to the elapsed time in the standby mode. The elapsed time range of over 35 seconds but below 45 seconds is the time period for operating the developing roller 201. Also, the elapsed time range of over 20 seconds but below 35 seconds is the time period for operating the applying roller 7.

Next, the third control procedure during the standby mode is as follows.

In the third control procedure, after the process of running the developing roller 201, which was described in the first and second control procedures, a patch image is prepared and an image is developed on the photoreceptor drum 1 based on the patch image before the developing roller is stopped.

Figure 7:
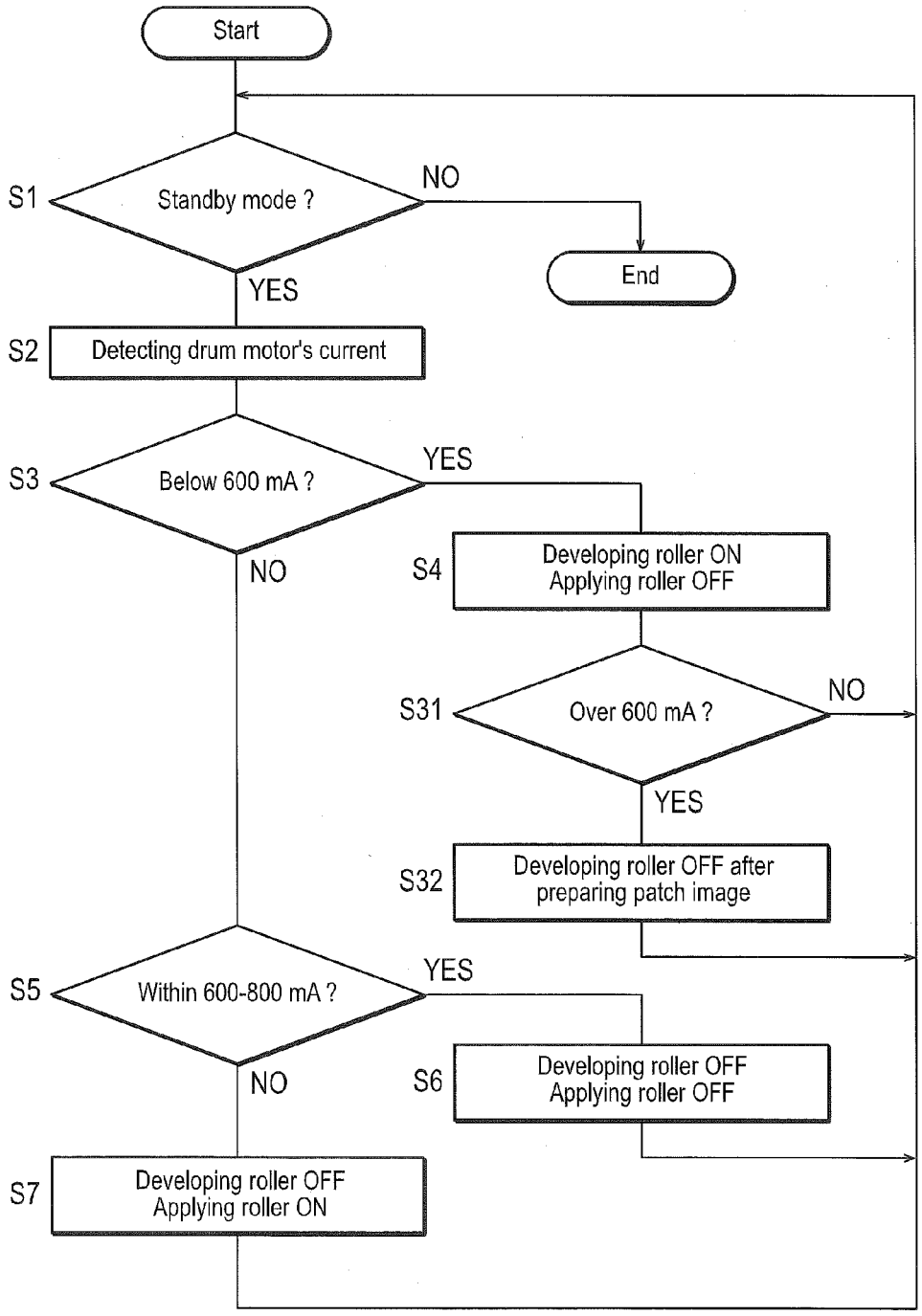
FIG. 7 is a flowchart showing a third control procedure by the control part referencing the first control procedure.

FIG. 7 is a flowchart showing a third control procedure by the control part 40 referencing the first control procedure.

First, similar to the first control procedure, it proceeds on to the control unique to the standby mode if it is determined to be the standby mode (S1: YES). The control part 40 receives the value of the current that flows from the ammeter 41 to the drum motor 101 (S2). It turns the developing roller ON and the applying roller ON when the current value of the drum motor 101 is lower than 600 mA (S3: YES). In other words, run the developing roller 201 and stop the applying roller 7 in this case.

As a next step in this third control procedure, a determination is made as to whether the current value of the drum motor 101 exceeds 600 mA or not (S31). At this point, if the current value of the drum motor 101 does not exceed 600 mA (S31: NO), the process returns to S1. On the other hand, if the current value of the drum motor 101 exceeds 600 mA (S31: YES), the developing roller 201 stops after preparing a patch image (S32). Then, the process returns to the step S1. The description of the process thereafter is omitted here because it is identical to that of the first control procedure.

Figure 8:
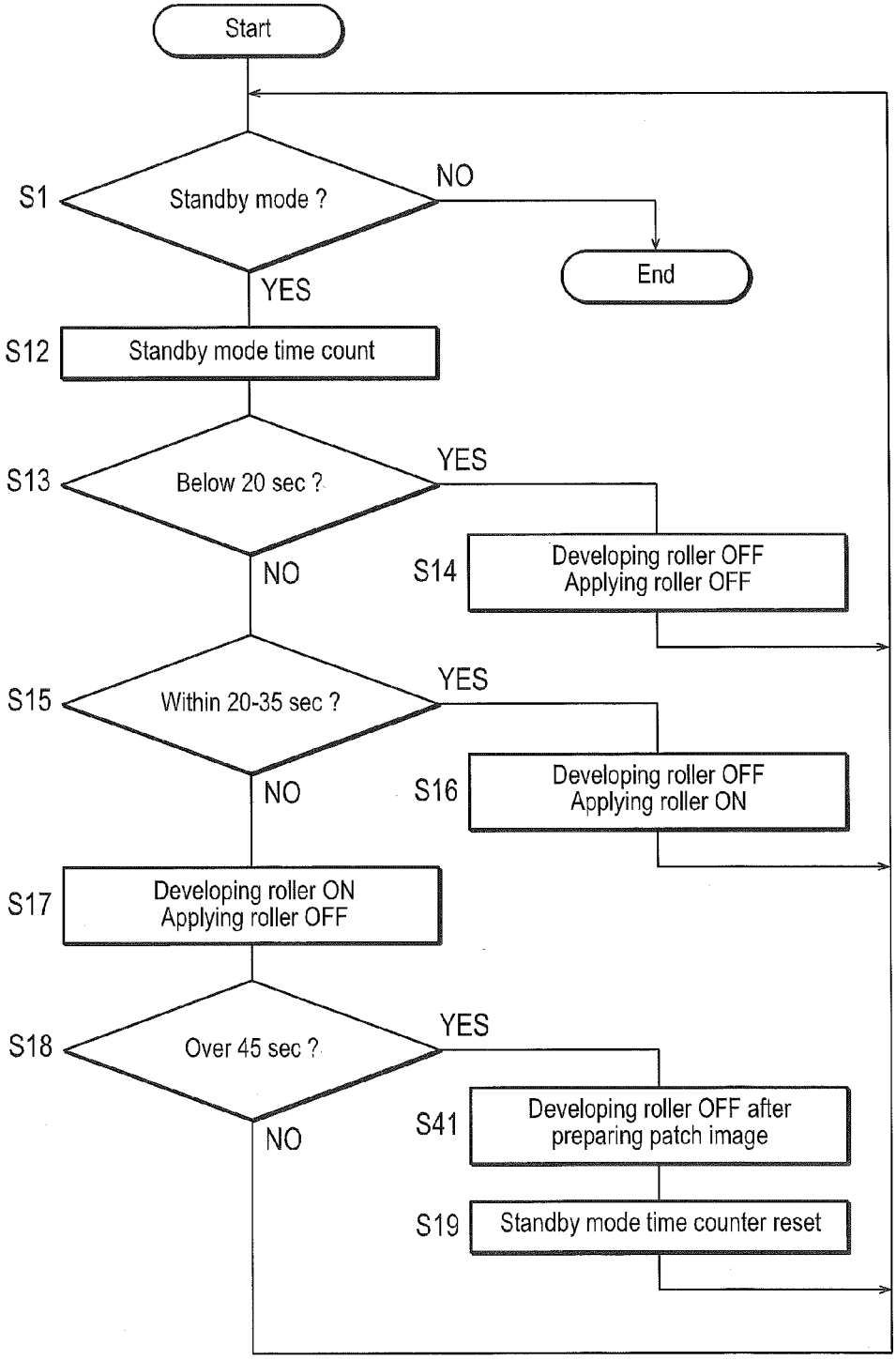
FIG. 8 is a flowchart showing a third control procedure by the control part based on the second control procedure.

FIG. 8 is a flowchart showing a third control procedure referencing the second control procedure.

In describing the third control procedure referencing the second control procedure, a patch image is prepared and the developing roller 201 is stopped (S41) when it is confirmed that the elapsed time exceeds 45 seconds (S18: YES) in the flowchart (FIG. 6) of the previously described second control procedure. After resetting the time counter (S19), the process returns to the step S1. The description of the other steps is omitted here because it is identical to that of the second control procedure (FIG. 6).

As can be seen from the above, it is possible to discharge any developing agent degraded during the standby period by running the developing roller 201 during the standby mode and preparing the patch image before stopping it. Thus, it is possible to form images using a fresh developing agent each time when the image forming process restarts, preventing the possibility of poor images being caused by the degradation of the development agent.

WORKING EXAMPLES

Using an image forming apparatus connected to a post-processing device, image forming was conducted by arranging the image forming operation to be in the standby mode.

The image forming operation is done as follow.

The image forming apparatus printed 100 A4 size sheets continuously and the post-processing device executed the bookbinding operation in the standby mode of the image forming apparatus. The time required for the printing operation (i.e., time spent for image forming mode) was 80 seconds and the bookbinding time (i.e., the standby mode time) was 100 seconds. The above mentioned chain of operation for one set of printing was repeated until 100 sets of printing were completed. The deterioration of the image was visually evaluated.

Working Example 1

In the Working Example 1, the start and stop of both the developing roller and the applying roller were controlled based on the current of the drive motor of the photoreceptor drum same as in the previously described first control procedure.

Working Example 2

In the Working Example 2, the start and stop of both the developing roller and the applying roller were controlled based on the elapsed time of the standby mode same as in the previously described second control procedure.

Comparative Example 1

In the Comparative Example 1, the developing roller and the applying roller were kept stopped during the standby mode.

Comparative Example 2

In the Comparative Example 2, the developing roller was kept stopped always during the standby mode, and the applying roller was controlled based on the current of the drive motor of the photoreceptor drum same as in the first control procedure described previously.

The result is shown in Table 3. When a degraded image caused by cleaning failure (for example, degraded image due to poor toner application or excessive application) is found on even a single sheet within a group of 20 copies while printing 100 copies, it is marked by "X"; if there is no failure, it is marked by "O" in Table 3.

TABLE 3

| No. of copies printed | Working Example 1 | Working Example 2 | Comparative Example 1 | Comparative Example 2 |
|---|---|---|---|---|
| 1-20 copies | good | good | good | good |
| 21-40 copies | good | good | not good | good |
| 41-60 copies | good | good | not good | not good |
| 61-80 copies | good | good | not good | not good |
| 81-100 copies | good | good | not good | not good |

As can be seen from Table 3, there was no failure in Working Example 1 and Working Example 2, until 100 copies were printed. On the other hand, no poor images were found while the number of copies was small but some image failures were not iced as the number of copies increase in the Comparative Examples 1 and 2. It can also be learned from the results of the Comparative Examples 1 and 2 that it is difficult to prevent cleaning failures as the number of printings increases by means of simply controlling the start and stop of the applying roller by the control part for adjusting the smoother application. It is learned from this fact that it is effective to control the start and stop of the developing roller in order to prevent the degrading images when the image forming is restarted from the standby mode.

The embodiments and working examples described above provide the following effects.

It is so designed that, in the standby mode, the control part controls the start and stop of the developing roller, as the image forming apparatus is not forming images but the photoreceptor drum is kept running. As a result, an appropriate amount of smoother is supplied during the standby mode by removing the smoother from the surface of the rotating drum with the help of smoother removal action of the developing roller, thus enabling to prevent image degradations when the image forming process is restarted.

Moreover, the control part controls the start and stop of the developing roller as well as the applying roller during the standby mode. In other words, the control of the applying roller during the standby mode means the control of the application amount of the smoother on the supply side. This makes it possible to prevent the image degradation when the image forming process is restarted by supplying an appropriate amount of the smoother during the standby mode. The start and stop of the applying roller is controlled, similar to the case of the developing roller, according to the measurement of the rotating load of the photoreceptor drum based on the current of the motor that drives the photoreceptor drum, or according to the elapsed time of the standby mode, in order to supply an appropriate amount of the smoother (applied on the photoreceptor drum).

The control part detects the load of the photoreceptor drum during the standby mode so that the developing roller is controlled to run when the detected load is within the specified load range and to stop when it is outside of the specified load range. Thus the control part can estimate the smoother amount from the change of the load applied on the photoreceptor drum, by which it can control the start and stop of the developing roller and/or the applying roller, so that the smoother amount can be maintained within an appropriate range. Also, since the detection of the load is made based on the current of the motor that drives the photoreceptor drum, the detection can be done easily.

The control part controls the developing roller to run when the elapsed time is within the specified time range since the start of the standby mode, and to stop when it is outside of the specified time range. Consequently, the control part can estimate the smoother amount on the surface of the photoreceptor drum based on the time elapsed since the start of the standby mode, by which it can control the start and stop of the developing roller and/or the applying roller, so that the smoother amount can be maintained within an appropriate range by simply changing the process procedure of the control part.

As it is designed to prepare the patch image when the control part causes the developing roller to run during the standby mode, the degraded developing agent is discharged during the standby mode. Therefore, the image forming apparatus can conduct the image forming process always with a fresh developing agent at the time of image forming restart. This is a particularly useful feature when a two-component type developing agent is used because it prevents the use of a development agent consisting of a toner and a carrier degraded after being left inactive for an extended period.

Although the present invention was described through the embodiments and working examples, the present invention should not be construed to be limited by those embodiments and working examples. For example, the current values and times mentioned in the embodiments are only examples and the specific values are set up depending on the design of each image forming apparatus. Also, the detection of the rotational load of the photoreceptor drum does not necessarily have to be based on the value of the current that flows to the drum motor.

The formation of the patch image can be done each time after the process involving the running of the developing roller, or can be done only once after several cycles of start and stop of the development roller. It is possible to discharge the degraded developing agent effectively by executing the patch image preparation at an interval of several cycles of start and stop of the developing roller, which can decrease the consumption of the development agent more efficiently than preparing the patch image in each cycle.

Although a constitution is described in the above embodiment of having a cleaning blade for removing the toner left on the photoreceptor drum without being transferred, a constitution without having such a cleaning member is also included in the scope of the present invention. In case of a constitution without the cleaning member, it can be so configured to have the developing roller to remove the toner remaining on the photoreceptor drum.

The photoreceptor drum does not necessarily have to have a cylindrical shape. For example, an endless belt-like member can be used for that purpose.

The invention can also be applied to an apparatus using a single component developing agent, not necessarily a two-component developing agent.

It goes without saying that the present invention can arbitrarily be added, modified and omitted by a person skilled in the art within the gist of the technology disclosed herein.

What is claimed is:

1. An image forming apparatus for the use with a smoother, the image forming apparatus comprising:

a rotatable image carrying member on a surface of which a latent image is formed, a developing roller structured to develop the latent image on the surface of the image carrying member by providing a developer to the latent image, an applying roller in contact with the surface of the image carrying member and structured to apply the smoother to the surface of the image carrying member, and a controller structured to determine whether the image forming apparatus is in a waiting mode wherein the image carrying member is rotated and is ready for a subsequent image forming operation, wherein the controller is structured to estimate an estimated amount of the smoother on the rotatable image carrying member, rotate the developing roller and stop the applying roller when the estimated amount of the smoother is above a predetermined maximum, and stop the developing roller and rotate the applying roller when the estimated amount of smoother is below a predetermined minimum, when the controller determines that the image forming apparatus is in the waiting mode.

2. An image forming apparatus of claim 1, wherein the controller is structured to stop the developing roller and the applying roller if the estimated amount of smoother is between the predetermined minimum and the predetermined maximum.

3. An image forming apparatus of claim 1 further comprising a load measurement section to measure load of the rotation of the image carrying member, and wherein the controller is structured to estimate the smoother amount from the load on the rotatable image carrying member and rotate the developing roller when the load of the rotation of the image carrying member measured by the load measurement section is within a predetermined range and stops the rotation of the developing roller when the load of the rotation of the image carrying member measured by the load measurement section is out of the predetermined range.

4. An image forming apparatus of claim 3 further comprising:

a motor to rotate the image carrying member, and a current measurement section to measure an electric current on the motor; and wherein the load measurement section measures load of the rotation of the image carrying member based on the electric current measured by the current measurement section.

5. An image forming apparatus of claim 1 further comprising a time measurement section to measure a length of time that has elapsed since the determination of that the image forming apparatus is in the waiting mode, and wherein the controller is structured to estimate the smoother amount based on the time elapsed since the start of the standby mode and rotate the developing roller when the length of the time measured by the time measurement section is within a predetermined range and stops the rotation of the developing roller when the length of the time measured by the time measurement section is out of the predetermined range.

6. An image forming apparatus of claim 1, wherein the controller controls the developing roller to form a patch image on the surface of the image carrying member at a predetermined timing during the rotation of the developing roller in the waiting mode.

7. A method performed in an image forming apparatus, the method comprising:

forming a latent image on a surface of a rotatable image carrying member, developing the latent image formed on the surface of the image carrying member by providing a developer from a developing roller to the latent image, applying a smoother to the surface of the image carrying member by an applying roller, determining whether the image forming apparatus is in a waiting mode wherein the image carrying member is rotated and is ready for a subsequent image forming operation, and when the controller determines that the image forming apparatus is in the waiting mode, performing the following:

estimating an estimated amount of the smoother on the rotatable image carrying member;

rotating the developing roller and stopping the applying roller when the estimated amount of the smoother is above a predetermined maximum;

stopping the developing roller and rotating the applying roller when the estimated amount of smoother is below a predetermined minimum.

8. A method of claim 7 further comprising stopping the developing roller and the applying roller if the estimated amount of the smoother is between the predetermined minimum and the predetermined maximum.

9. A method of claim 8 further comprising:

measuring load of the rotation of the image carrying member, estimating the estimated amount of the smoother from the load on the rotatable image carrying member; and rotating the developing roller when the measured load of the rotation of the image carrying member is within a predetermined range and stopping the rotation of the developing roller when the measured load of the rotation of the image carrying member is out of the predetermined range.

10. A method of claim 9 further comprising measuring an electric current on a motor which rotates the image carrying member, and wherein the load of the rotation of the image carrying member is measured based on the measured electric current.

11. A method of claim 8 further comprising:

measuring a length of time that has elapsed since the determination of that the image forming apparatus is in the waiting mode, and estimating the smoother amount based on the on the time elapsed since the start of the standby mode, and rotating the developing roller when the measured length of the time is within a predetermined range and stopping the rotation of the developing roller when the measured length of the time is out of the predetermined range.

12. A method of claim 8 further comprising controlling the developing roller to form a patch image on the surface of the image carrying member at a predetermined timing during the rotation of the developing roller in the waiting mode.

13. A method of claim 8 further comprising:

measuring load of the rotation of the image carrying member, and rotating the applying roller when the measured load of the rotation of the image carrying member is within a predetermined range and stopping the rotation of the applying roller when the measured load of the rotation of the image carrying member is out of the predetermined range.

14. A method of claim 13 further comprising measuring an electric current on a motor which rotates the image carrying member, and wherein the load of the rotation of the image carrying member is measured based on the measured electric current.

15. A method of claim 8 further comprising:

measuring a length of time that has elapsed since the determination of that the image forming apparatus is in the waiting mode, and rotating the applying roller when the measured length of the time is within a predetermined range and stopping the applying roller when the measured length the time is out of the predetermined range.

* * * * *